United States Patent [19]

Dunn, Jr.

[11] Patent Number: 4,984,733

[45] Date of Patent: Jan. 15, 1991

[54] DUAL MAILER CONSTRUCTION

[75] Inventor: Daniel L. Dunn, Jr., Glendale Heights, Ill.

[73] Assignee: Uarco Incorporated, Barrington, Ill.

[21] Appl. No.: 403,814

[22] Filed: Sep. 7, 1989

[51] Int. Cl.[5] ..... B65D 27/06; B65D 27/08; B65D 27/10; B65D 27/34

[52] U.S. Cl. ..... 229/72; 229/69; 229/73; 282/11.5 R; 493/216; 493/920

[58] Field of Search ..... 229/69, 72, 73; 282/11.5 R, 11.5 A; 493/216, 920

[56] References Cited

U.S. PATENT DOCUMENTS

| | | | |
|---|---|---|---|
| 681,659 | 8/1901 | Sallade | 229/72 X |
| 1,141,688 | 6/1915 | Chamberlain et al. | 229/72 |
| 1,163,459 | 12/1915 | Rheutan | 229/72 |
| 1,453,758 | 5/1923 | Field | 229/72 |
| 2,156,142 | 4/1939 | Blitz | 282/25 |
| 2,189,273 | 2/1940 | Shomaker | 229/72 |
| 2,631,046 | 3/1953 | Stephens | 283/56 |
| 3,104,799 | 9/1963 | Steidinger | 229/69 |
| 3,211,469 | 10/1965 | Chamberlain | 229/69 X |
| 3,713,673 | 1/1973 | Katz | 281/3 R |
| 3,941,307 | 3/1976 | Van Malderghem | 229/69 |
| 4,508,224 | 4/1985 | Weber et al. | 229/72 X |
| 4,589,590 | 6/1986 | McGuire et al. | 229/92.8 |
| 4,632,427 | 12/1986 | Angus | 229/73 X |
| 4,747,535 | 5/1988 | Haase et al. | 229/73 X |

FOREIGN PATENT DOCUMENTS

| | | | |
|---|---|---|---|
| 138501 | 4/1985 | European Pat. Off. | 282/11.5 A |
| 2591567 | 6/1987 | France | 229/73 |

*Primary Examiner*—Stephen Marcus
*Assistant Examiner*—Jes F. Pascua
*Attorney, Agent, or Firm*—Wood, Phillips, Mason, Recktenwald & VanSanten

[57] ABSTRACT

Unit mailing costs of promotional mailing may be reduced utilizing a dual mailer including first and second stuffed envelope assemblies (12), (14), in side-by-side relation joined by a line of weakening (18), wherein one of the envelope assemblies (12) contains a frank (30) while being free of address information and the other of the envelope assemblies (14) includes an address receiving area (32) while being free of a frank. A first message (Offer #1) is contained within the first envelope assembly (12), and a second message (Offer #2) different from the first message (Offer #1), is contained within the second envelope assembly (14).

9 Claims, 2 Drawing Sheets

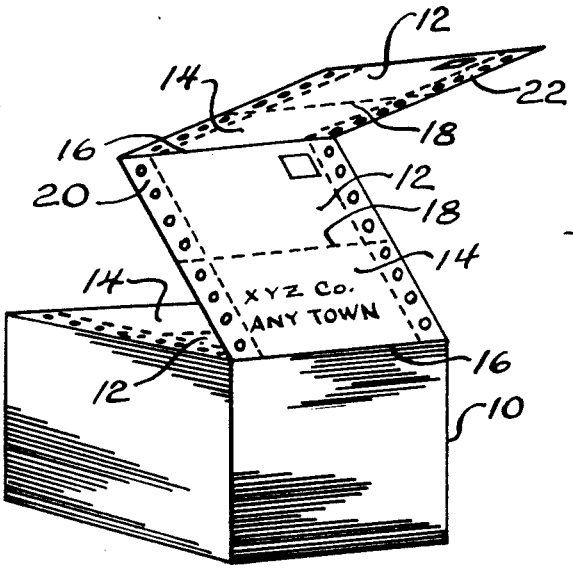
FIG. 1
FIG. 2
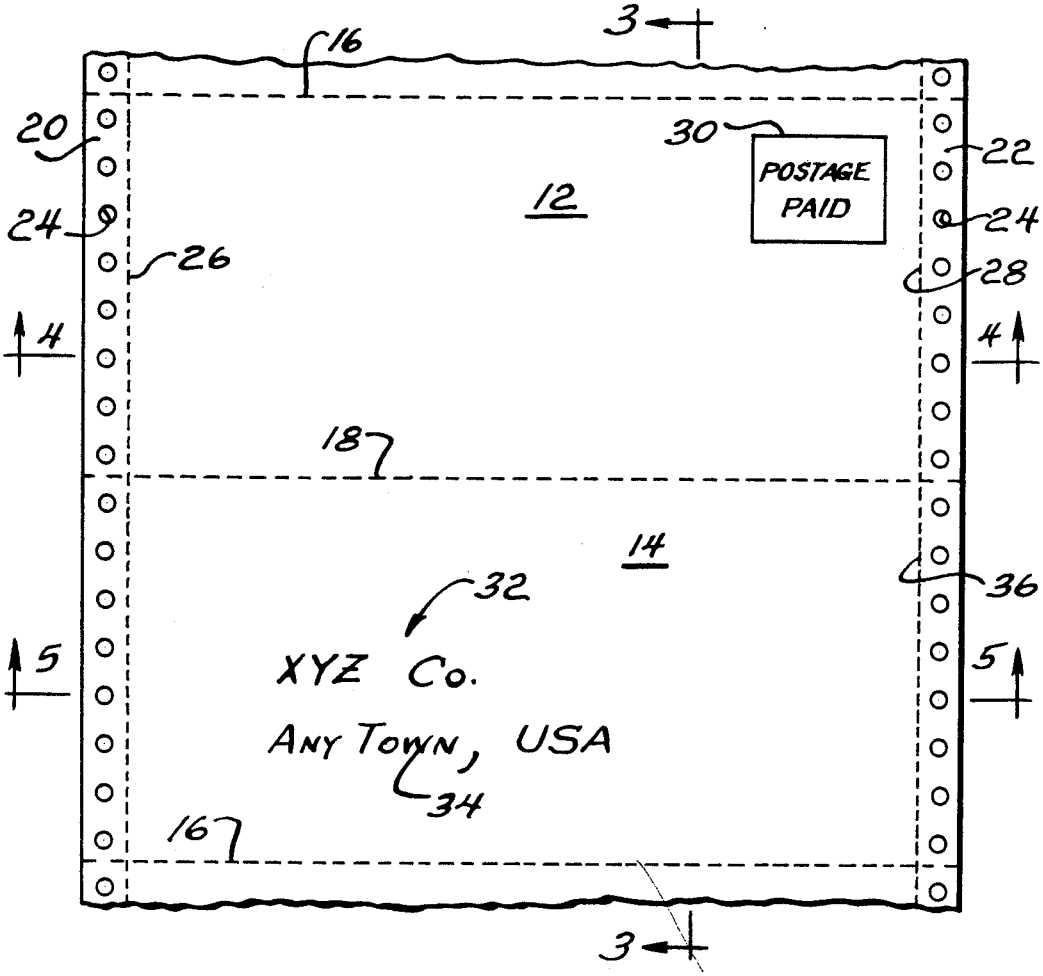

DUAL MAILER CONSTRUCTION

FIELD OF THE INVENTION

This invention relates to a mailer construction that is particularly adapted for use in promotional mailings and which is intended to accomplish the same dissemination of material that would normally require two or more mailings to accomplish at the cost of but a single mailing.

BACKGROUND OF THE INVENTION

Promotional mailings are and have been a significant part of present day life. As technology has become more sophisticated, as with large scale use of computer operated printers, ink jet printing and the like, the scale of promotional mailings has increased. That is to say, the number of mailings made has increased as has the number of intended recipients for any given mailing.

Because of the sophisticated technology utilized and alluded to above, the increases are readily tolerable from most cost standpoints. However, economies of scale and/or decreases in per unit cost as a result of improved technologies do not apply to one facet of promotional mailings—the cost of postage. Except in the case of extremely small mailings, the unit cost of a mailing remains the same regardless of the number of pieces in a given mailing or the number of mailings made by a given source.

The present invention is intended to reduce the unit cost of promotional mailing.

SUMMARY OF THE INVENTION

It is the principal object of the invention to provide a new and improved mailer that may effectively disseminate the same number of differing materials as plural mailings, but at the cost of but a single mailing. It is also an object of the invention to provide a method of mailing plural distinct messages in distinct envelopes to a single location at the cost of a single mailing.

According to one aspect of the invention, there is provided a dual mailer that includes first and second stuffed envelope assemblies in side-by-side relation and joined by a line of weakening. One of the envelope assemblies is franked while being free of address information, while the other of the envelope assemblies includes an address receiving area while being free of a frank. A first message is contained within the first envelope assembly and a second message different from the first message is contained within the second envelope assembly.

As a consequence of this construction, a single frank on one envelope and the single address on the other envelope joined thereto provide all that is necessary to accomplish delivery of two distinct envelopes bearing two distinct messages.

In a highly preferred embodiment of the invention, two elongated plies define the fronts and backs of a plurality of sets of mailers, and each set of mailers is made-up of two side-by-side envelopes. At least one additional ply is disposed between the elongated plies and is divided into a plurality of sets of message bearing panels with each set being made-up of two side-by-side panels. First message indicia appear on one panel of each set and second message indicia different from the first message indicia appear on the other panel of each set. Glue joins opposed longitudinal edges of the elongated plies to at least partially seal the envelopes and the message bearing panels therein. First lines of weakening extend between the longitudinal edges of the elongated plies to separate the mailer sets and second lines of weakening, each of greater strength than the first lines of weakening, extend between the longitudinal edges of the elongated plies to separate the envelopes of each mailer set. Franking indicia is disposed on the front of each mailer set on only one mailer thereof.

In a preferred embodiment of the invention, the elongated plies are free from connection to one another along the second lines of weakening.

In a highly preferred embodiment of the invention, the elongated plies are connected to each other along the first lines of weakening, but not along the second lines of weakening.

In a highly preferred embodiment, the message bearing panels are die cut so as to not extend across the second lines of weakening or into the glue joining one longitudinal edge of the elongated plies. A further ply is disposed between the additional ply and one of the elongated plies and is joined to the latter along both the first and second lines of weakening, and along one of the longitudinal edges thereby defining a pair of pockets within each mailer set. The first and second lines of weakening extend through the further ply to allow the pockets of each mailer set to be separated and used as return envelopes, and return mail frank indicia is provided on each of the pockets of each of the sets, along with different return address indicia on each pocket of each set.

According to another facet of the invention, there is provided a method of simultaneously mailing two distinct messages in distinct envelopes to a single location at the cost of a single frank, which comprises the steps of:

A. providing two envelopes joined in side-by-side relation and separated by a line of weakening;

B. placing different messages in each of the envelopes;

C. placing a frank on only one of the envelopes;

D. placing a recipient address on only one of the envelopes; and

E. depositing the franked, addressed assembly in the mail without severing the line of weakening.

In a preferred embodiment of the method, step D. is performed on the envelope that is not used during the performance of step C., that is, step D. is performed by placing the recipient address only on the other of the envelopes.

The invention contemplates that step A. be performed by joining two plies at least about two opposite peripheral edges and perforating the plies between the edges.

Step B. may be performed by placing die cut inserts bearing different indicia between the plies prior to the joining thereof.

Other objects and advantages become apparent from the following specification taken in connection with the accompanying drawings.

DESCRIPTION OF THE DRAWINGS

FIG. 1 is a perspective view of a continuous business forms assembly of dual mailers made according to the invention;

FIG. 2 is an enlarged, fragmentary plan view of one mailer of the set;

DESCRIPTION OF THE PREFERRED EMBODIMENTS

Figure 3:
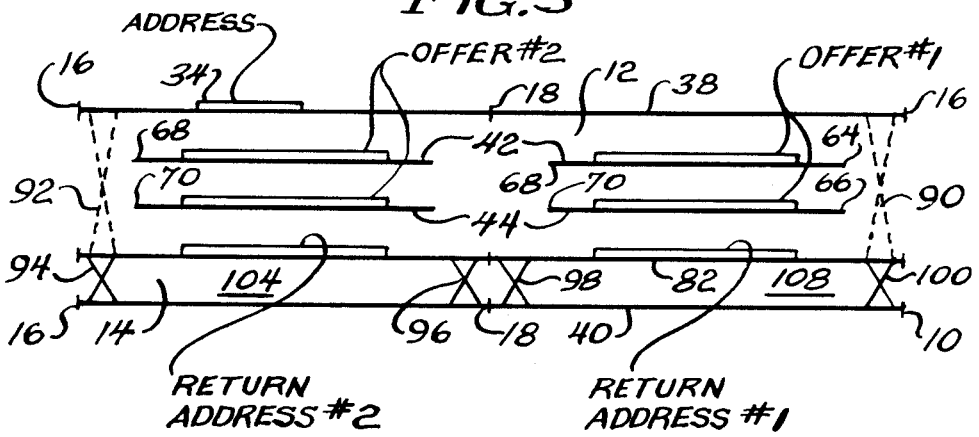
FIG. 3 is a schematic, sectional view taken approximately along the line 3—3 of FIG. 2.

An exemplary embodiment of a mailer made according to the invention is illustrated in the drawings and with reference to FIG. 1 is seen to be in the form of a zig-zag folded stack 10 of continuous mailers made according to the invention. In the exemplary embodiment of the invention, each mailer is made up of two envelopes 12 and 14 in side-by-side relationship, and adjacent mailers are separated from one another by first cross lines of weakening 16, such as perforations, upon which the assembly is zig-zag folded to form the stack 10. The envelopes 12 and 14 of each mailer are in turn separated from one another by second cross lines of weakening 18 which are somewhat stronger than the cross lines of weakening 16. Consequently, when the assembly is run through conventional processing equipment such as a burster or the like, bursting will occur on the lines 16, but not on the lines 18 because of the greater strength of the latter.

Longitudinal edges of the assembly are provided with removable control punch margins 20 and 22 including pinfeed openings 24 which are utilized during both the manufacture of the form, as well as during the processing thereof as is well known. Typically, but not always, the control punch margins 20 and 22 may be separated from the rest of the form by respective, longitudinally extending lines of weakening 26 and 28, respectively, which again may be in the form of perforations.

As best seen in FIG. 2, each of the envelopes 12 is provided with a frank 30. The frank 30 may be a postage stamp or even the imprint of a postage meter. More likely, however, it will simply be a printed indication that the postage has been paid and bearing an identification of the permit number. It is to be noted that there is no exposed frank on the envelope 14.

The envelope 14 of each mailer includes an address receiving area 32 whereat recipient address information may be received. The recipient address information 34 may be printed in the area 32 by any suitable means known in the art. It is to be noted that there is no area intended to receive recipient address information exposed on the envelope 12 of each mailer.

Completing the description of the invention as illustrated in FIG. 2, it will be seen that adjacent the line of weakening 28, and just inwardly thereof, there is another line of weakening 36, which also may be formed of perforations or the like, whereby the right-hand edge of the mailer may be removed to open the same as will be seen.

Figure 4:
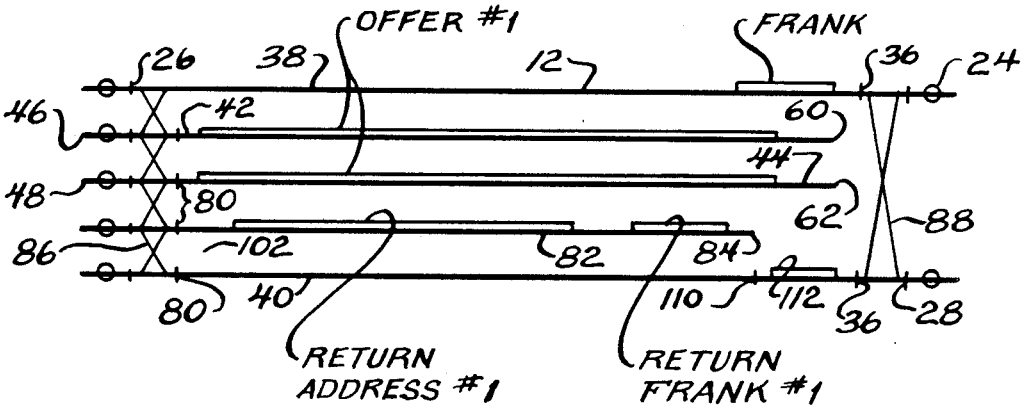
FIG. 4 is a schematic, sectional view taken approximately along the line 4—4 in FIG. 2.
Figure 5:
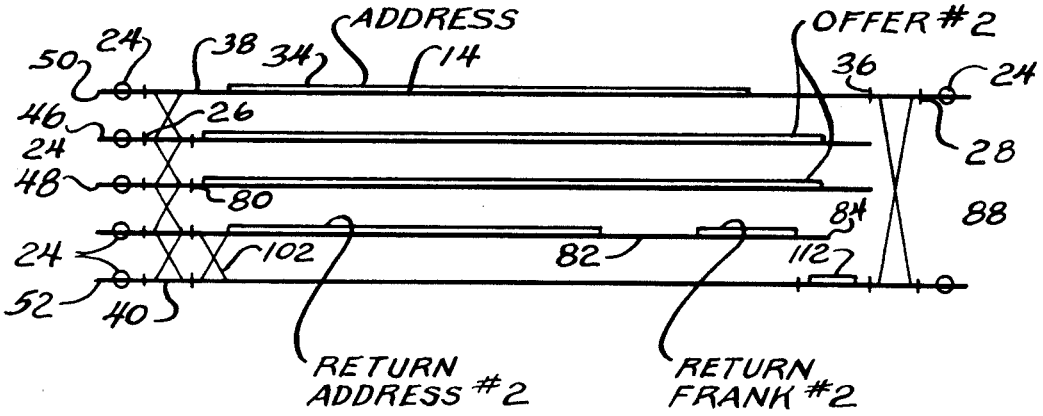
FIG. 5 is a schematic, sectional view taken approximately along the line 5—5 in FIG. 2.

Referring now to FIGS. 3–5 inclusive, each mailer is made up of part of several plies of paper. A top ply is shown at 38 and constitutes the front of the mailer, while a bottom ply 40 constitutes the back of the mailer. As is well known, the plies 38 and 40 are elongated and the control punch margins 20 and 22 are formed on their longitudinal edges.

Intermediate the plies 38 and 40 are one or more additional plies. As illustrated in FIGS. 3–5, two such additional plies 42 and 44 are included and are placed between the plies 38 and 40 before they are joined together. The plies 42 and 44 may be die cut in the same fashion as the intermediate plies shown, for example, in U.S. Pat. No. 3,104,799 issued to D. J. Steidinger, the details of which are herein incorporated by reference.

That is to say, and as seen in FIGS. 4 and 5, the left-hand marginal edges 46 and 48 of the plies 42 and 44 are coextensive with the marginal edges 50 and 52 of the top and bottom plies 38 and 40, and include pinfeed openings 24 therein, as well as the perforation or line of weakening 26. Conversely, the right-hand marginal edges 60 and 62 of the plies 42 and 44 are cut to stop short of the line of weakening 36 as can be plainly seen in FIGS. 4 and 5.

In addition, top and bottom marginal edges 64, 66 and 68 and 70 of the plies 42 and 44 are cut to be spaced from adjacent lines of weakenings 16 or 18 as can be seen in FIG. 3. Thus, the plies 42 and 44 are connected to the mailer along but one marginal edge of the former, and may be maintained in proper position for registration if that is desired, but are otherwise secured within the mailer. To facilitate the release of the plies 42 and 44, an interior line of weakening 80 is located in the plies 42, 44, as well as the ply 40, inwardly of the line of weakening 26. By severing the plies 42 and 44 on the line of weakening 80, they may be disconnected from either one of the envelopes 12 and 14.

The assembly also includes a further interior ply 82 which is located between the ply 44 and the bottom ply 40. The ply 82 is not die cut and thus extends fully between the lines of weakening 16 as illustrated in FIG. 3. However, its right-hand marginal edge 84 is terminated inwardly of the line of weakening 36 as can be seen in FIGS. 4 and 5.

A glue line 86 located between the longitudinal lines of weakening 26 and 80 joins the plies 38, 40, 42, 44 and 82, together along their left-hand marginal edge. A similar glue line 88 extends directly between the plies 36 and 40 between the lines of weakening 28 and 36. Thus, the top and bottom plies 38 and 40 are joined at at least two opposite marginal edges to essentially close the envelope.

If desired, cross lines of frangible glue shown at 90 and 92 may be located on either side of the cross lines of weakening 16 and extend between the further ply 82 and the top ply 38 to fully close each mailer. It is particularly to be observed that no cross glue lines such as the lines 90 or 92 and which extend between the ply 38 and the ply 82 are in the vicinity of the cross lines of weakening 18.

However, between the plies 40 and 82, and on both sides of each of the lines of weakening 16 and 18 are respective glue lines 94, 96, 98 and 100. These glue lines along with a glue line 102 (FIGS. 4 and 5) between the plies 40 and 82 just inwardly of the line of weakening 80, define a three-sided pocket 104 in the envelope 14 and a three-sided pocket 108 in the envelope 12. These pockets 104 and 108 serve as the interiors of return envelopes and a flap for the same is defined by the provision of a fold-line 110 that runs longitudinally of the form and is located in the bottom ply 40 inwardly of the line of weakening 36 and aligned with the edge 84 of the ply 82. Remoistenable adhesive or pressure sensitive adhesive 112 may be located on the flap thus defined and may be folded over the edge 84 and adhered to the ply 82 to seal such return envelope.

In addition to the frank 30 and address indicia 34 printed on the envelope 14, the location of other indicia is important to the invention. For example, because two pockets 104 and 108 are defined and each may define a return envelope that may be separated from the other along the line of weakening 18, and because it is desirable to provide for the conveyance or dissemination of material equal to two mailings through the use of the mailer, it is equally desirable that there be the ability to provide two separate return envelopes bearing different return addresses when desired. This is illustrated schematically in FIG. 3 by the legends "Return Address #1" and "Return Address #2" the former being on the return envelope associated with the envelope 12, and the latter being associated with the return envelope associated with the envelope 14. Both of the return envelopes require franking and, as a consequence, and as seen in FIG. 4, a designation "Return Frank #1" is located on the upper surface of the ply 82 and specifically that part thereof associated with the envelope 12. A designation "Return Frank #2" shows the location of the frank on that part of the ply 82 associated with the envelope 14 as seen in FIG. 5. Both of these franking designations will be preprinted and may be the same or may be different depending upon whether the same or a different organization is to pay the price of the return postage.

In furtherance of the object to facilitate the dissemination of multiple mailings in but a single mailing, the plies 42 and 44 serve as message bearing panels and it will be readily appreciated that there are two such panels defined by the ply 42 within each mailer, and two such panels defined by the ply 44 within each such mailer, and the two panels of each such set are separated from one another by the die cutting while being in side-by-side relation in the vicinity of the second lines of weakening 18.

Thus, promotional indicia such as an offer or the like, may be located on the plies 42 and 44 associated with the envelope 12 and bear the legend "Offer #1" as seen in FIGS. 3 and 4. A second, but different offer indicia, bears the legend "Offer #2" as shown in FIGS. 3 and 5 and will typically be associated with those parts of the plies 42 and 44 associated with each envelope 14.

In use, the various indicia are located in the areas previously described by any suitable means before, during or, in the case of the address 34, after the assembly of the mailer. The mailers are burst from one another along the cross lines of weakening 16, and typically the control punch margins 20 and 22 will be removed.

Upon receipt of the mailer, the recipient, through a suitable printed instruction not shown, removes the right-hand edge of the mailer along the line of weakening 36. This allows the top ply 38 to be folded back to expose the panels 42 and 44. Where frangible glue such as the glue lines 90 and 92 are used, the folding back operation is accompanied by peeling the ply 38 away from the ply 82.

The message bearing panels defined by the plies 42 and 44 may be separated from the assemblage along the lines of weakening 80, as may be the return envelopes. The return envelopes may then be utilized as desired by the recipient.

It will be observed that because the indicia as, for example, an offer, may vary from one envelope 12 to the other envelope 14, different promotional offerings may be made with a single frank 30 and with the capability of providing return envelopes that may have different return addresses, one for each of the offers.

While the invention has been shown and described in connection with an assembly where there are but two envelopes 12 and 14 to a single mailer within the stack 10, in some instances additional envelopes might be included in each set utilizing the principles of the invention. In all events, by utilizing a mailer made according to the invention, the unit cost of the original mailing may be cut in half, since only one frank 30 for a mailer consisting of two distinct envelopes 12 and 14 containing two different promotional items is required.

I claim:

1. A dual mailer comprising:

first and second stuffed envelope assemblies in side-by-side relation and joined by a line of weakening;

one of said envelope assemblies being franked while being free of address information;

the other of said envelope assemblies including an address receiving area while being free of a frank;

a first message contained within said first envelope assembly; and a second message different from said first message contained within said second envelope assembly.

2. A method of simultaneously mailing two distinct messages in distinct envelopes to a single location at the cost of a single frank comprising the steps of:

(a) providing two envelopes joined in side-by-side relation and separated by a line of weakening;

(b) placing different messages in each of said envelopes;

(c) placing a frank on only one of the envelopes;

(d) placing a recipient address on only one of the envelopes; and (e) depositing the franked, addressed assembly in the mail without severing said line of weakening.

3. The method of claim 2 wherein step (d) is performed on the envelope that is not used in the performance of step (c), that is, by placing the recipient address only on the other of said envelopes.

4. The method of claim 2 wherein step (a) is performed by joining two plies at least about two opposite peripheral edges, and perforating the plies between said edges.

5. The method of claim 4 wherein step (b) is performed by placing die cut inserts bearing differing indicia between said plies prior to the joining thereof.

6. A dual mailer assembly comprising:

two elongated plies defining the front and backs of a plurality of sets of mailers, each set being made up of two side-by-side envelopes;

at least one additional ply between said elongated plies and being divided into a plurality of sets of message bearing panels, each set being made up of two side-by-side panels;

first message indicia on one panel of each set;

second message indicia different from the first message indicia on the other panel of each set;

glue joining opposed longitudinal edges of said elongated plies to at least partially seal said envelopes and the message bearing panels therein;

first lines of weakening extending between said longitudinal edges of said elongated plies to separate said mailer sets;

second lines of weakening, each of greater strength than said first lines of weakening, extending between said longitudinal edges of said elongated plies to separate the envelopes of each mailer set; and franking indicia on the front of each mailer set on only one envelope thereof.

7. The dual mailer of claim 6 wherein said elongated plies are free from connection to one another along said second lines of weakening.

8. The dual mailer of claim 6 wherein said elongated plies are connected to each other along said first lines of weakening, but not along said second lines of weakening.

9. The dual mailer of claim 6 wherein said message bearing panels are die cut so as not to extend across said first and second lines of weakening and into the glue joining one longitudinal edge of said elongated plies, said elongated plies being free from connection to each other along said second lines of weakening and including a further ply between said at least one additional ply and one of said elongated plies and joined thereto along both said first and second lines of weakening and along one of said longitudinal edges thereby define a pair of pockets within each mailer set, said first and second lines of weakening extending through said further ply to allow the pockets of each mailer set to be separated and used as return envelopes, return mail frank indicia on each of said pockets of each of said sets and different return address indicia on each pocket of each set.

* * * * *